US006533215B2

(12) United States Patent
Crain

(10) Patent No.: US 6,533,215 B2
(45) Date of Patent: Mar. 18, 2003

(54) FENCE SPOOL APPARATUS

(76) Inventor: Thomas M. Crain, 517 Brigham Cir., Canton, GA (US) 30115

( * ) Notice: Subject to any disclaimer, the term of this patent is extended or adjusted under 35 U.S.C. 154(b) by 0 days.

(21) Appl. No.: 10/097,770

(22) Filed: Mar. 14, 2002

(65) Prior Publication Data

US 2002/0100833 A1 Aug. 1, 2002

Related U.S. Application Data

(63) Continuation-in-part of application No. 09/872,534, filed on Jun. 1, 2001, now abandoned.
(60) Provisional application No. 60/210,790, filed on Jun. 12, 2000.

(51) Int. Cl.[7] ..... B65H 75/18
(52) U.S. Cl. ..... 242/597.7; 242/406
(58) Field of Search ..... 242/597.4, 597.7, 242/406, 129

(56) References Cited

U.S. PATENT DOCUMENTS 472,593 A * 4/1892 Tache ..... 242/406
1,871,483 A * 8/1932 Uitendaal ..... 242/406
1,933,163 A * 10/1933 Coplen ..... 242/597.7
2,480,461 A * 8/1949 Gabrielson ..... 242/597.7
2,562,650 A * 7/1951 Trunkhill ..... 242/597.7
3,414,211 A * 12/1968 Roberts ..... 242/406
5,167,377 A * 12/1992 Chalmers ..... 242/597.4
5,497,958 A * 3/1996 Orf et al. ..... 242/597.7

* cited by examiner

*Primary Examiner*—William A. Rivera

(57) ABSTRACT

A fence spool apparatus includes ground penetration element for penetrating a portion of ground, ground contacting plate element from which a portion of the ground penetration element extend downward therefrom, vertical stabilizer element positioned on top of the ground contacting plate element, ground penetrator driver element for driving a portion of said ground penetration element into the ground, spindle shaft and spool reception element stabilized by the vertical stabilizer element, and top of shaft control element supported by the spindle shaft and spool reception element. In one embodiment, the ground penetrating member is fixed to a base plate, and the ground penetrating member is hammered into the ground with the employment of a small hammer-impaction member. In another embodiment, the ground penetrating member is independent of the base plate and is hammered into the ground using a spindle shaft unit.

22 Claims, 6 Drawing Sheets

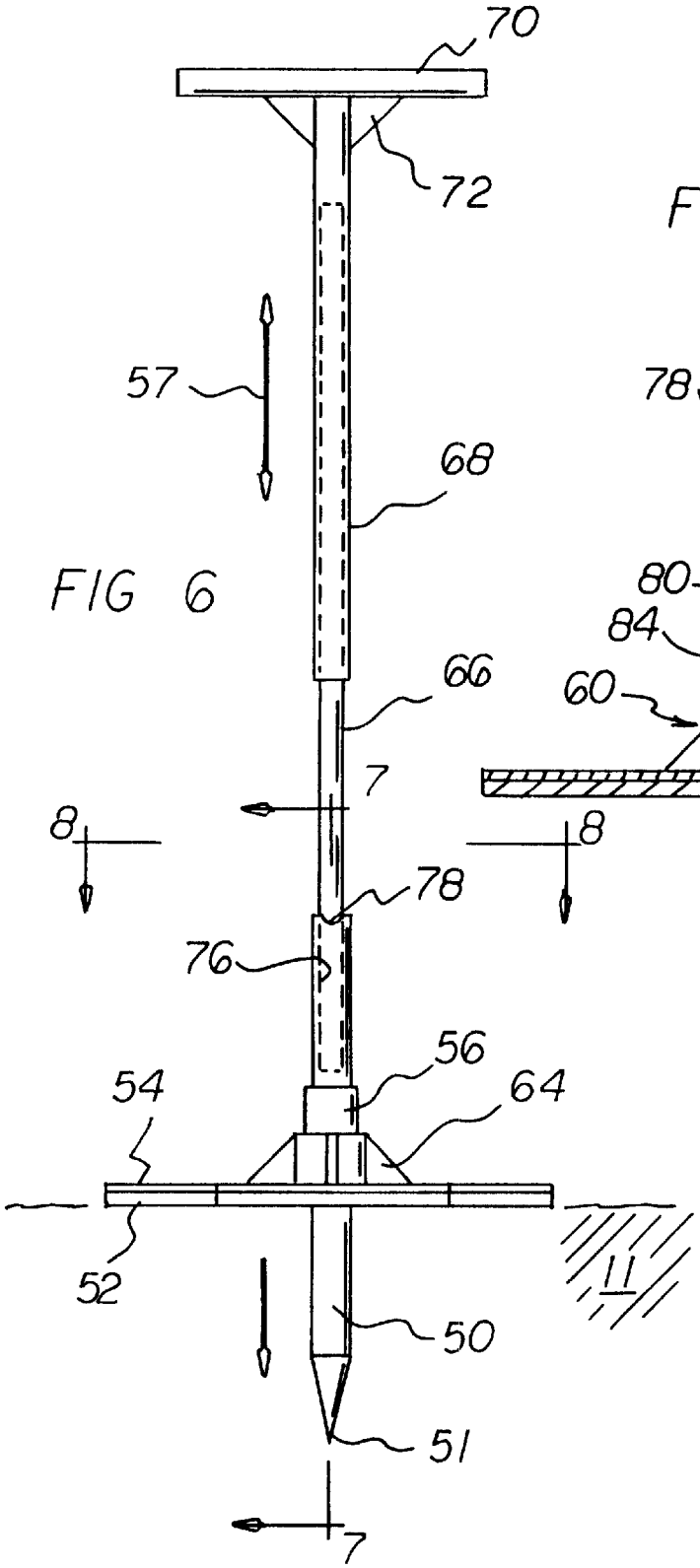
FIG 6
FIG 7
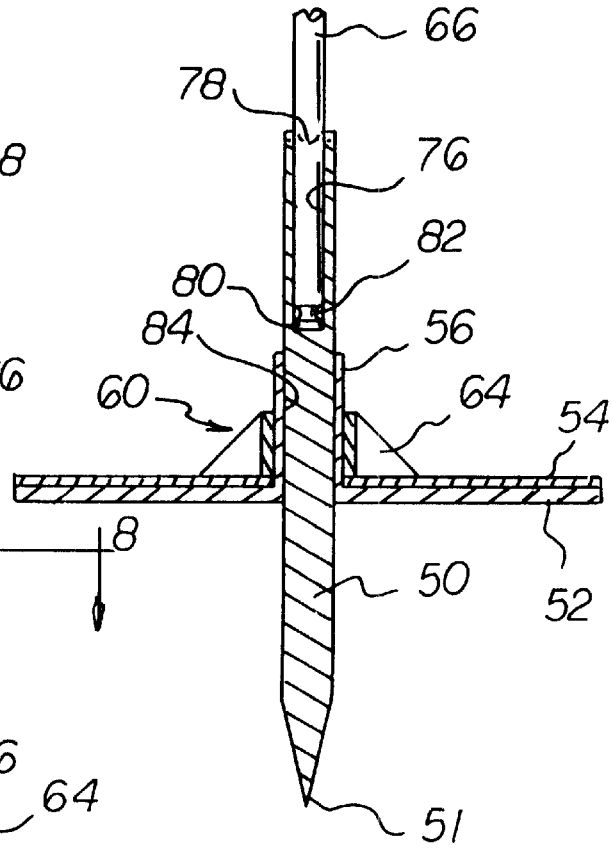

FENCE SPOOL APPARATUS

RELATED APPLICATION

This application is a continuation-in-part of my prior U.S. patent application Ser. No. 09/872,534, filed Jun. 1, 2001 now abandoned; which in turn, is based on Provisional Application Serial No. 60/210,790, filed Jun. 12, 2000.

BACKGROUND OF THE INVENTION

1. Field of the Invention

The present invention relates generally to devices for paying out flexible material wound on a spool and, more particularly, to a device especially adapted for paying out flexible fencing material wound on a spool.

2. Description of the Prior Art

Flexible fence material is a type of fence material that is easy to pay out from a spool for installation onto fence posts. In general, the art of paying out flexible material from a spool is crowded with many innovations, and the following U.S. patents are representative of some of those innovations: U.S. Pat. Nos. 524,657, 1,674,709, 1,871,483, 3,162,390, and 5,497,958. More specifically, each of U.S. Pat. Nos. 524,657, 1,674,709, and 1,871,483 discloses a device for paying out relatively small diameter strands of wire from a spool. Such devices are not suitable for paying out sheets of flexible fence material. In this respect, it would be desirable if a device were provided for paying out flexible fence material.

U.S. Pat. No. 3,162,390 discloses a device from which flexible cloth material can be dispensed from a spool. The cloth material is wound into a bolt of cloth which is supported by a spindle. However, there is no disclosure of dispensing flexible fence material from a spool. Moreover, it is noted that this device does not disclose structures attached to the spindle, either at the top or the bottom of the spindle, for centering the bolt of cloth on the spindle. In the art of dispensing flexible fence material, it is important that a spool of fence material be centered on a spindle and be prevented from sliding upward on the spindle and potentially slipping off of the spindle. In this respect, it would be desirable if a device, that provides flexible fence material from a spool, includes structures for centering the spool on the spindle.

U.S. Pat. No. 5,497,958 discloses a device for dispensing flexible fence material from a spool. Stabilization of the device in the ground is accomplished by the use of four relatively short base member stakes are arrayed circumferentially around the spool. In addition, extra stake members are provided in the ground outside the base member. A total of six stake members are disclosed in U.S. Pat. No. 5,497,958. For purposes of simplicity, it would be desirable if a fence spool apparatus were provided which includes a ground penetrating member that is located coaxial with the longitudinal axis of the spool.

Still other features would be desirable in a fence spool apparatus. For example, good stabilization of the apparatus depends upon secure stabilization of the apparatus in the ground. In this respect, it would be desirable if fence spool apparatus were provided which includes an adaptor which is designed to receive hammer blows for driving a ground-penetrating member into the ground.

Thus, while the foregoing body of prior art indicates it to be well known to use devices for dispensing flexible material from a spindle, the prior art described above does not teach or suggest a fence spool apparatus which has the following combination of desirable features: (1) provides for paying out flexible fence material; (2) provides flexible fence material from a spool which includes structures for centering the spool on a spindle; (3) provides a ground-penetrating member that is located coaxial with the longitudinal axis of the spool; and (4) includes an adaptor which is designed to receive hammer blows for driving the ground-penetrating member into the ground. The foregoing desired characteristics are provided by the unique fence spool apparatus of the present invention as will be made apparent from the following description thereof. Other advantages of the present invention over the prior art also will be rendered evident.

SUMMARY OF THE INVENTION

To achieve the foregoing and other advantages, the present invention, briefly described in general terms, a fence spool apparatus includes ground penetration means for penetrating a portion of ground, ground contacting plate means from which a portion of the ground penetration means extend downward therefrom, vertical stabilizer means positioned on top of the ground contacting plate means, ground penetrator driver means for driving a portion of said ground penetration means into the ground, spindle shaft and spool reception means stabilized by the vertical stabilizer means, and top of shaft control means supported by the spindle shaft and spool reception means.

More specifically, with respect to the first embodiment of the invention, the ground penetration means include base fixing portion, the ground contacting plate means include base plate portion, and the base fixing portion and the base plate portion are unified as a base unit.

The vertical stabilizer means include bottom spindle unit which includes spindle plate portion and bottom shaft-reception sleeve depending upward from the spindle plate portion. The ground penetrator driver means include hammer-impaction member, and spindle-reception well, in the base plate portion, which receives a portion of the hammer-impaction member. The spindle shaft and spool reception means include spindle shaft unit. The top of shaft control means include fence spool centering assembly supported by the spindle shaft unit.

Even more specifically with respect to the first embodiment of the invention, a fence spool apparatus includes a base unit which includes a base plate portion, a base fixing portion projecting out from a bottom side of the base plate portion, and a spindle-reception well extending into a top side of the base plate portion. A bottom spindle unit includes a spindle plate portion, a spindle member projecting out from a bottom side of the spindle plate portion, and a bottom shaft-reception sleeve extending up from a top side of the spindle plate portion. A spindle shaft unit is received in the bottom shaft-reception sleeve.

The base fixing portion is in a form of a pointed spike. A hammer-impaction member can be received in the spindle-reception well when the spindle member is not received in the spindle-reception well. The base fixing portion and the spindle-reception well are located along a longitudinal axis.

A bottom fence spool centering assembly extends between the spindle plate portion and the bottom shaft-reception sleeve. The bottom centering assembly includes a plurality of bottom centering rod members which extend between the spindle plate portion and the bottom shaft-reception sleeve.

A top fence spool centering assembly is attached to a top portion of the spindle shaft unit. The top centering assembly includes a top shaft-reception sleeve attached to a top portion of the spindle shaft unit. A plurality of top centering rods are connected to a top portion of the top shaft-reception sleeve and a bottom portion of the top shaft-reception sleeve and extend radially outward from the top shaft-reception sleeve.

The spindle shaft unit includes a first spindle shaft member received in the bottom shaft-reception sleeve, and a second spindle shaft member is connected to the first spindle shaft member. The first spindle shaft member can be connected to the second spindle shaft member by screwing the two shaft members together.

To use the first embodiment of the fence spool apparatus, the base unit is secured to the ground, a roll of wire fence is mounted on the spindle shaft unit, the bottom spindle unit is placed on the base unit, the top centering assembly is placed on the spindle shaft unit, and a free end of the wire fence is pulled, whereby the roll of wire fence is unrolled with the roll of wire fence spinning on the fence spool apparatus.

More specifically with respect to the second embodiment of the invention, the ground penetration means include a ground penetration member which includes a ground penetration point at a distal end and a shaft reception well at a proximal end. The ground contacting plate means include a base plate portion. The vertical stabilizer means include a tubular ground-penetration-member reception sleeve attached to a top side of the base plate portion. The ground penetrator driver means include a spindle shaft unit received in the shaft reception well. The spindle shaft and spool reception means include a spindle shaft unit which is received in the shaft reception well. The top of shaft control means include a shaft jacket portion for placement over a top portion of the spindle shaft unit and include a handle portion attached to a top portion of the shaft jacket portion.

Even more specifically with respect to the second embodiment of the invention, the fence spool apparatus includes a base plate portion and a tubular ground-penetration-member reception sleeve connected to the base plate portion and extending upward therefrom. A ground penetration member is received in the tubular ground-penetration-member reception sleeve, for penetrating the ground therethrough. The ground penetration member includes a ground penetration point at a distal end and a shaft reception well at a proximal end. A spindle shaft unit includes a distal shaft end and a proximal shaft end. The distal shaft end is received in the shaft reception well. A shaft jacket portion is positioned around the proximal shaft end, and a handle portion is connected to a top portion of the shaft jacket portion. The handle portion is perpendicular to the shaft jacket portion.

Preferably, top centering wings are connected between the handle portion and the shaft jacket portion. Optionally, a cover plate is placed on top of the base plate portion. The cover plate includes a ground-penetration-member reception channel. Optionally, a bottom centering unit is placed on top of the cover plate. The bottom centering unit includes a ground-penetration-member-reception channel and bottom centering wings attached to walls of the ground-penetration-member-reception channel.

The ground penetration member can include notches located at a top rim of walls forming the shaft reception well. The distal shaft end can include a shaft end hammer head and a shaft end groove located proximal to the shaft end hammer head.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fence spool apparatus which has all of the advantages of the prior art and none of the disadvantages.

It is another object of the present invention to provide a new and improved fence spool apparatus which may be easily and efficiently manufactured and marketed.

It is a further object of the present invention to provide a new and improved fence spool apparatus which is of durable and reliable construction.

An even further object of the present invention is to provide a new and improved fence spool apparatus which is susceptible of a low cost of manufacture with regard to both materials and labor, and which accordingly is then susceptible of low prices of sale to the consuming public, thereby making such fence spool apparatus available to the buying public.

Still yet a further object of the present invention is to provide a new and improved fence spool apparatus which provides for paying out flexible fence material.

Still another object of the present invention is to provide a new and improved fence spool apparatus that provides flexible fence material from a spool which includes structures for centering the spool on a spindle.

Yet another object of the present invention is to provide a new and improved fence spool apparatus which provides a ground-penetrating member that is located coaxial with the longitudinal axis of the spool.

Even another object of the present invention is to provide a new and improved fence spool apparatus that includes an adaptor which is designed to receive hammer blows for driving the ground-penetrating member into the ground.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 6 is a side view showing a second embodiment of the fence spool apparatus of the invention installed in the ground.

FIG. 7 is an enlarged partial cross-sectional view of the embodiment of the invention shown in FIG. 6, taken along line 7—7 thereof.

DESCRIPTION OF THE PREFERRED EMBODIMENT

Figure 1:
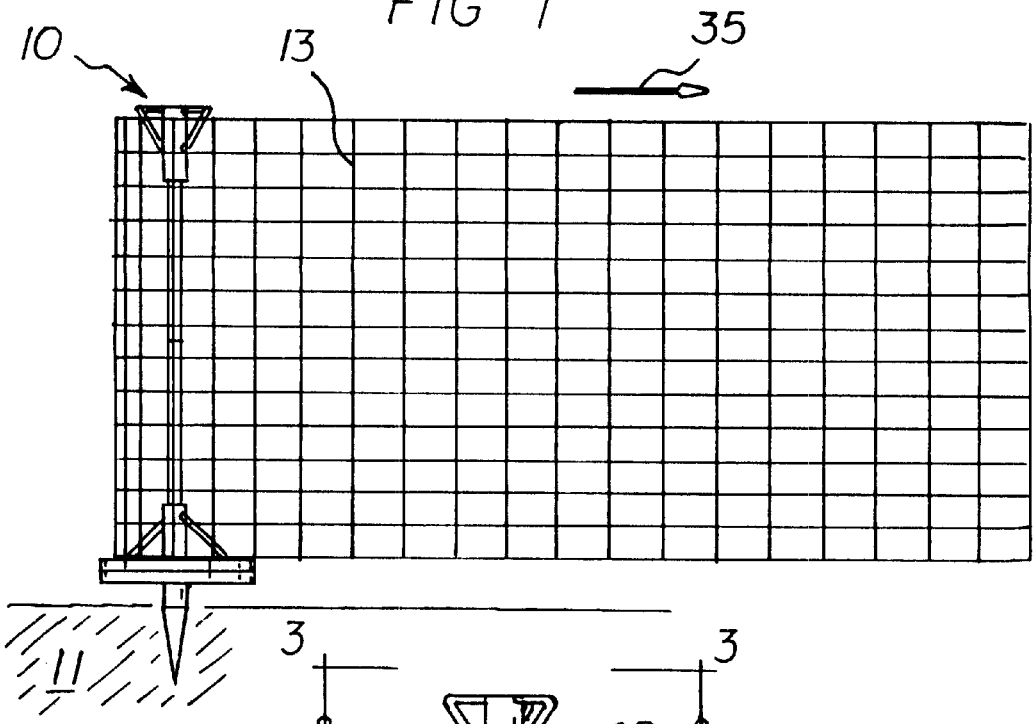
FIG. 1 is a side view showing a first embodiment of the fence spool apparatus of the invention installed in the ground and holding a roll of wire fence which is being unrolled from the fence spool apparatus.
Figure 2:
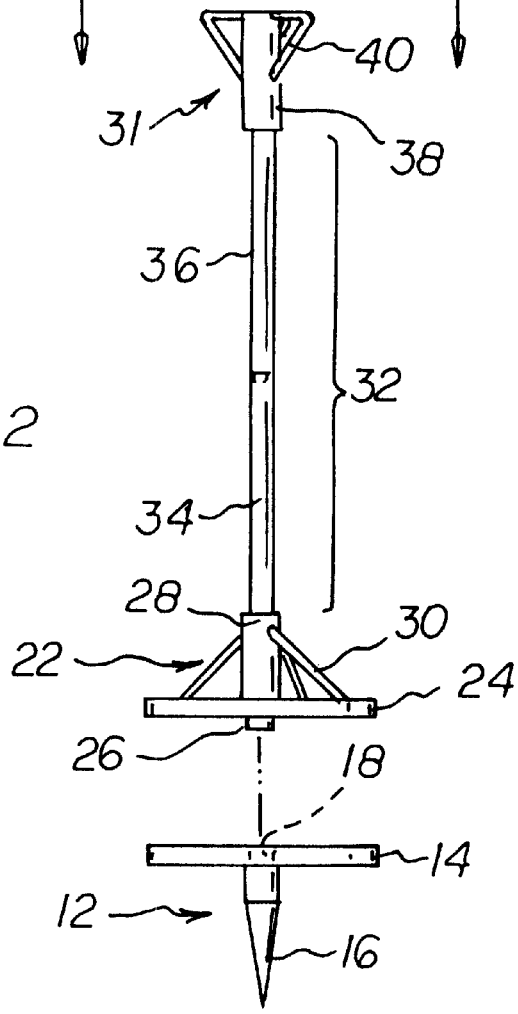
FIG. 2 is an enlarged, partially exploded side view of the embodiment of the invention shown in FIG. 1, removed from the ground and with the wire fence removed from the apparatus.
Figure 3:
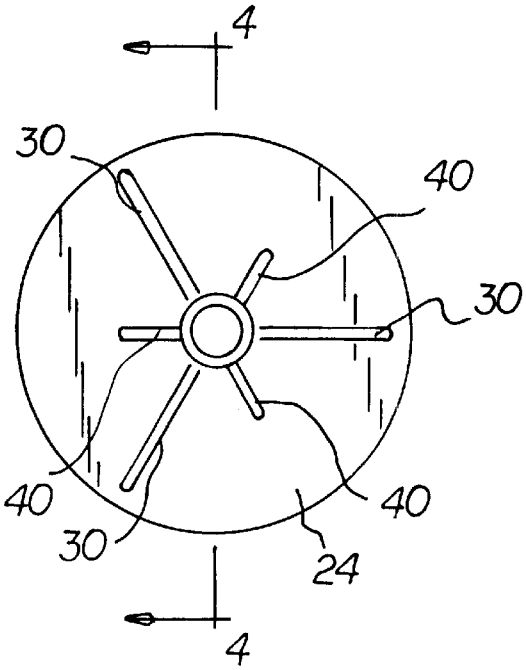
FIG. 3 is an enlarged top view of the embodiment of the invention shown in FIG. 2 taken along line 3—3 thereof.
Figure 4:
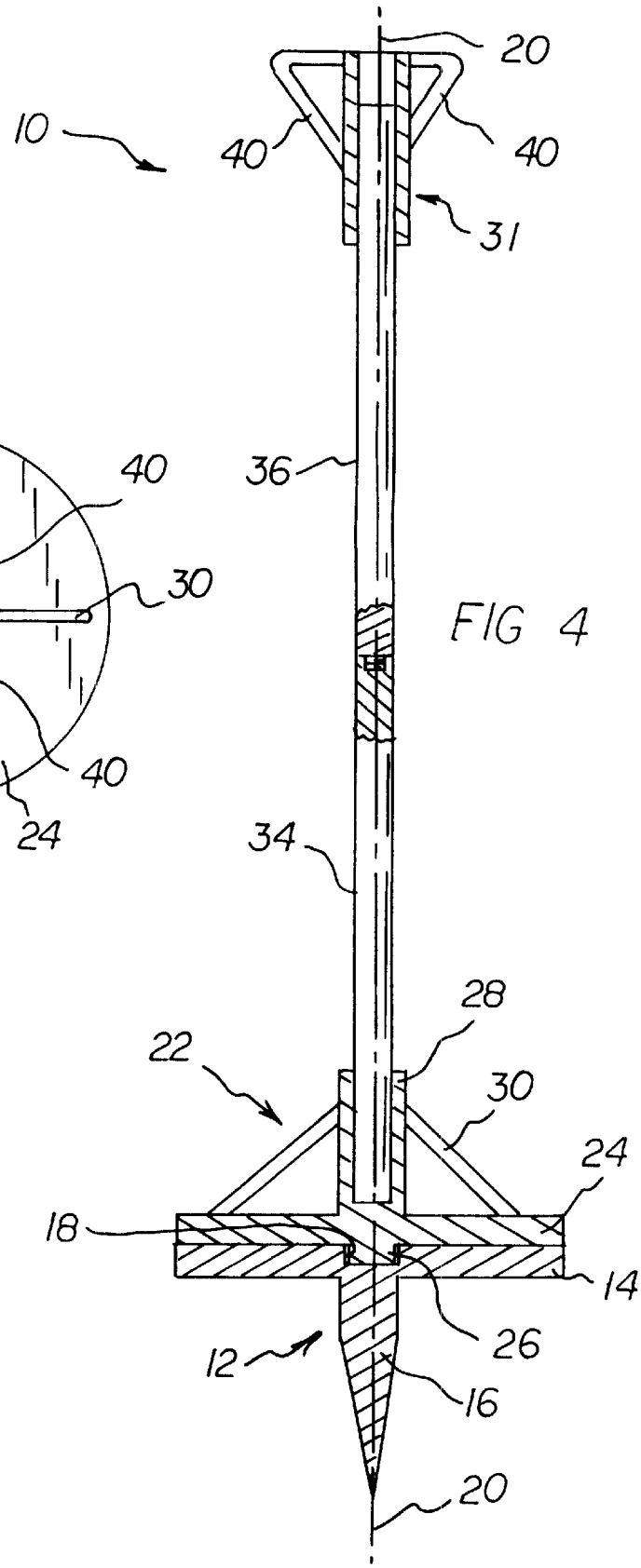
FIG. 4 is a cross-sectional view of the embodiment of the invention shown in FIG. 3 taken along line 4—4 thereof.
Figure 5:
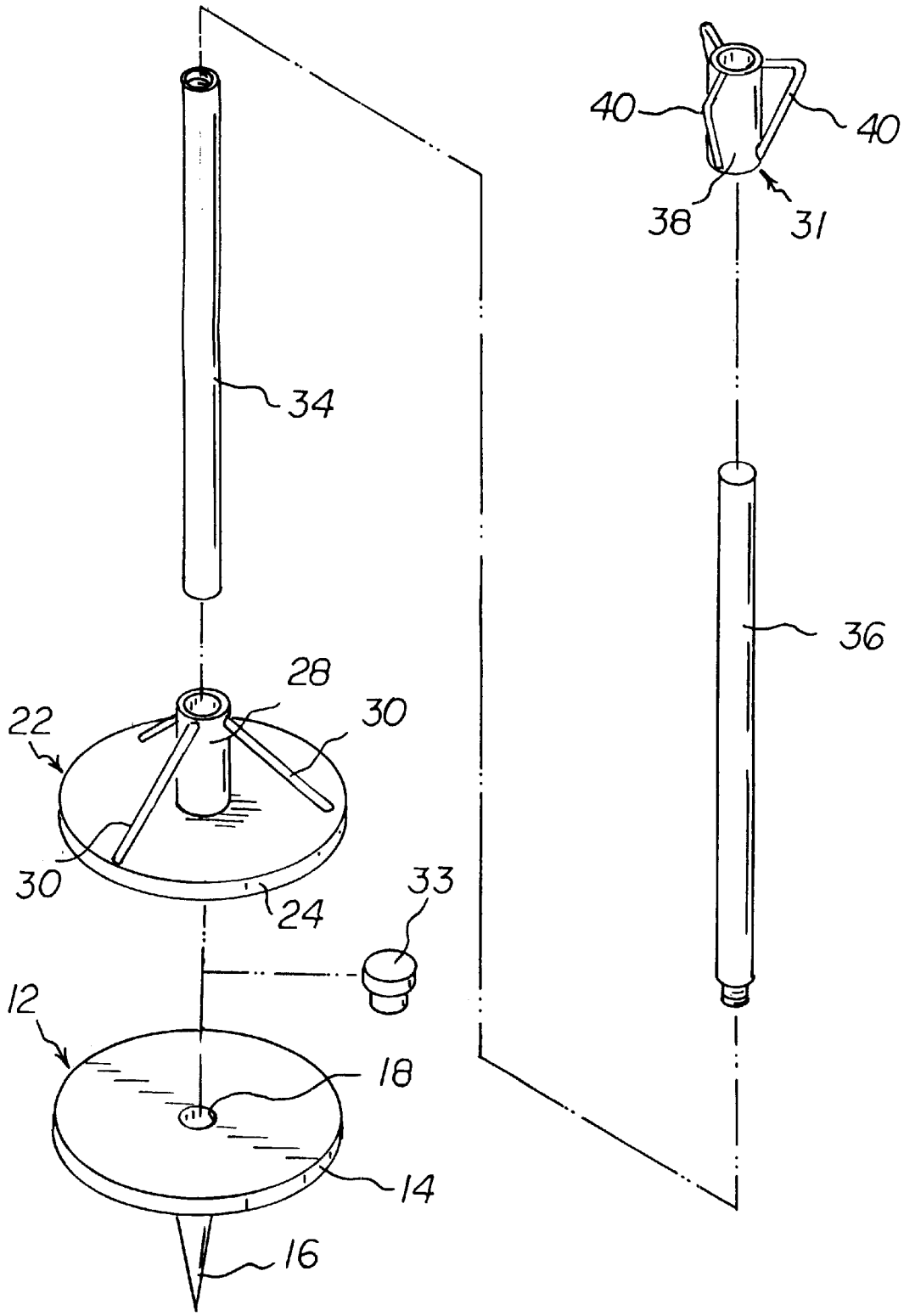
FIG. 5 is an exploded perspective view of the embodiment of the invention shown in FIGS. 1–4.
Figure 8:
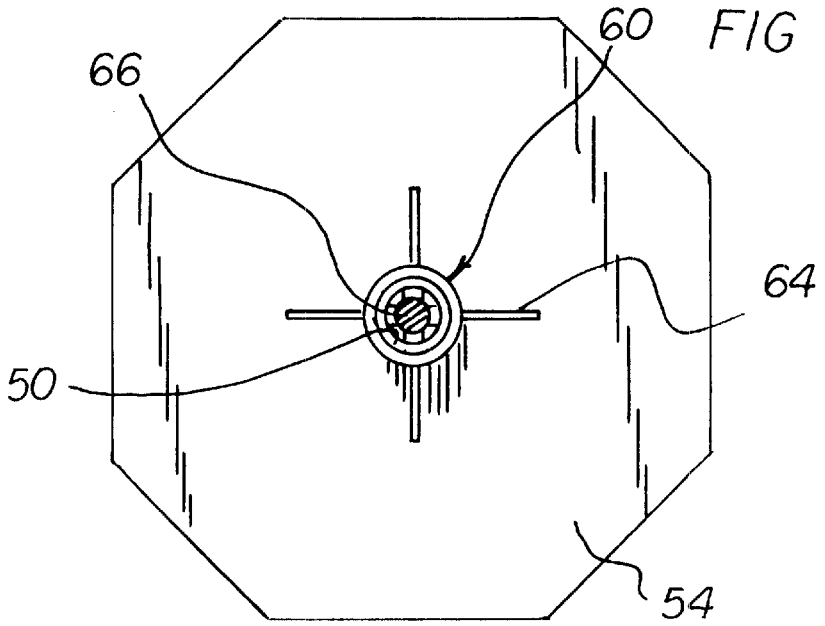
FIG. 8 is an enlarged partial cross-sectional view of the embodiment of the invention shown in FIG. 6, taken along line 8—8 thereof.

With reference to the drawings, a new and improved fence spool apparatus embodying the principles and concepts of the present invention will be described.

Briefly described in general terms, a fence spool apparatus includes ground penetration means for penetrating a portion of ground, ground contacting plate means from which a portion of the ground penetration means extend downward therefrom, vertical stabilizer means positioned on top of the ground contacting plate means, ground penetrator driver means for driving a portion of said ground penetration means into the ground, spindle shaft and spool reception means stabilized by the vertical stabilizer means, and top of shaft control means supported by the spindle shaft and spool reception means.

Turning to FIGS. 1–5, there is shown a first embodiment of the fence spool apparatus of the invention generally designated by reference numeral 10. In the first embodiment, fence spool apparatus 10 includes a base unit 12 which includes a base plate portion 14, a base fixing portion 16 projecting out from a bottom side of the base plate portion 14, and a spindle-reception well 18 extending into a top side of the base plate portion 14. A bottom spindle unit 22 includes a spindle plate portion 24, a spindle member 26 projecting out from a bottom side of the spindle plate portion 24, and a bottom shaft-reception sleeve 28 extending up from a top side of the spindle plate portion 24. A spindle shaft unit 32 is received in the bottom shaft-reception sleeve 28.

The base fixing portion 16 is in a form of a pointed spike 16. A hammer-impaction member 33 can be received in the spindle-reception well 18 when the spindle member 26 is not received in the spindle-reception well 18. The base fixing portion 16 and the spindle-reception well 18 are located along a longitudinal axis 20.

A bottom fence spool centering assembly extends between the spindle plate portion 24 and the bottom shaft-reception sleeve 28. The bottom centering assembly includes a plurality of bottom centering rod members 30 which extend between the spindle plate portion 24 and the bottom shaft-reception sleeve 28.

A top fence spool centering assembly 31 is attached to a top portion of the spindle shaft unit 32. The top centering assembly 31 includes a top shaft-reception sleeve 38 attached to a top portion of the spindle shaft unit 32. A plurality of top centering rods 40 are connected to a top portion of the top shaft-reception sleeve 38 and a bottom portion of the top shaft-reception sleeve 38 and extend radially outward from the top shaft-reception sleeve 38.

The spindle shaft unit 32 includes a first spindle shaft member 34 received in the bottom shaft-reception sleeve 28, and a second spindle shaft member 36 is connected to the first spindle shaft member 34. The first spindle shaft member 34 can be connected to the second spindle shaft member 36 by screwing the two shaft members together.

With one way of using the fence spool apparatus 10 of the invention, a portion of the ground 11 is selected where a wire fence 13 is to be installed. The base unit 12 is obtained, and the hammer-impaction member 33 is placed in the spindle-reception well 18. The pointed spike 16 of the base unit 12 is placed on the ground 11, and the pointed spike 16 is driven into the ground by hammering on the hammer-impaction member 33. When the base plate portion 14 rests upon the ground 11, the hammer-impaction member 33 is removed from the base plate portion 14.

Then, the bottom spindle unit 22 is obtained, and the spindle shaft unit 32 is fitted into the bottom shaft-reception sleeve 28. With the two-part spindle shaft unit 32 shown in the drawings, the first spindle shaft member 34 is fitted into the bottom shaft-reception sleeve 28, and the bottom portion of the second spindle shaft member 36 is screwed into the top portion of the first spindle shaft member 34.

Then, the unified spindle shaft unit 32 and bottom spindle unit 22 are laid on the ground 11, and a roll of wire fence 13 is slipped onto the spindle shaft unit 32. With the roll of wire fence 13 mounted on the spindle shaft unit 32, the combination is lifted off of the ground 11 so that the roll of wire fence 13 is oriented vertically.

Then, the spindle member 26 of the bottom spindle unit 22 is moved into the spindle-reception well 18. Then, the top centering assembly 31 is mounted on the top of the spindle shaft unit 32. In this way, the roll of wire fence 13 is centered between the bottom centering rod members 30 of the bottom centering assembly and the top centering rods 40 of the top centering assembly 31.

Then, a free end of the roll of wire fence 13 can be pulled, such as in the direction shown by arrow 35 in FIG. 1. When this occurs, the bottom side of the spindle plate portion 24 rotates on the top side of the base plate portion 14, and the spindle member 26 rotates in the spindle-reception well 18.

When the fence spool apparatus 10 is no longer needed, the top centering assembly 31 is removed from the spindle shaft unit 32, the spindle shaft unit 32 is tilted down, the remainder of the roll of wire fence 13 is removed from the spindle shaft unit 32, the bottom spindle unit 22 is separated from the base unit 12, and the base unit 12 is pulled out from the ground 11. The components of the fence spool apparatus 10 can be stored until they are needed further.

With the second embodiment of the invention, shown in FIGS. 6–10, the ground penetration means include a ground penetration member 50 which includes a ground penetration point 51 at a distal end and a shaft reception well 76 at a proximal end. The ground contacting plate means include a base plate portion 52. The vertical stabilizer means include a tubular ground-penetration-member reception sleeve 56 attached to a top side of the base plate portion 52. The ground penetrator driver means include a spindle shaft unit 66 received in the shaft reception well 76. The spindle shaft and spool reception means include a spindle shaft unit 66 which is received in the shaft reception well 76. The top of shaft control means include a shaft jacket portion 68 for placement over a top portion of the spindle shaft unit 66 and include a handle portion 70 attached to a top portion of the shaft jacket portion 68.

More specifically, the second embodiment of the fence spool apparatus includes a base plate portion 52 and a tubular ground-penetration-member reception sleeve 56 connected to the base plate portion 52 and extending upward therefrom. A ground penetration member 50 is received in the tubular ground-penetration-member reception sleeve 56, for penetrating the ground 11 therethrough. The ground penetration member 50 includes a ground penetration point 51 at a distal end and a shaft reception well 76 at a proximal end. A spindle shaft unit 66 includes a distal shaft end 53 and a proximal shaft end 55. The distal shaft end 53 is received in the shaft reception well 76. A shaft jacket portion 68 is positioned around the proximal shaft end 55, and a handle portion 70 is connected to a top portion of the shaft jacket portion 68. The handle portion 70 is perpendicular to the shaft jacket portion 68.

Preferably, top centering wings 72 are connected between the handle portion 70 and the shaft jacket portion 68. Optionally, a cover plate 54 is placed on top of the base plate portion 52. The cover plate 54 includes a ground-penetration-member reception channel 58. Optionally, a bottom centering unit 60 is placed on top of the cover plate 54. The bottom centering unit 60 includes a ground-penetration-member-reception channel 62 and bottom centering wings 64 attached to walls of the ground-penetration-member-reception channel 62.

The ground penetration member 50 can include notches 78 located at a top rim of walls forming the shaft reception well 76. The distal shaft end 53 can include a shaft end hammer head 80 and a shaft end groove 82 located proximal to the shaft end hammer head 80.

To use the second embodiment of the invention, shown in FIGS. 6–10, a portion of the ground 11 is selected, and the base plate portion 52 is placed on the selected portion of the ground 11. For a roll of wire fence 15 having a relatively large diameter core, the cover plate 54 is placed on top of the base plate portion 52 by having the ground-penetration-member reception channel 58 pass around the tubular ground-penetration-member reception sleeve 56. The bottom centering unit 60 is placed around the tubular ground-penetration-member reception sleeve 56 by having the ground-penetration-member-reception channel 62 pass around the tubular ground-penetration-member reception sleeve 56.

Then, the distal end of the ground penetration member 50 is threaded through the tubular ground-penetration-member reception sleeve 56 so that the ground penetration point 51 contacts the ground 11. The distal shaft end 53 of the spindle shaft unit 66 is placed in the shaft reception well 76 so that the shaft end hammer head 80 rests on the bottom of the shaft reception well 76. The shaft jacket portion 68 is placed over the proximal shaft end 55 of the spindle shaft unit 66, and the handle portion 70 is grasped by a user.

Then, using a vertically up and down longitudinal motion, depicted by straight arrow 57, the user hammers the proximal shaft end 55 with the inside of the handle portion 70, or another structure inside the top of the shaft jacket portion 68. As the proximal shaft end 55 is hammered, the shaft end hammer head 80 drives the ground penetration member 50 into the ground 11.

Figure 9:
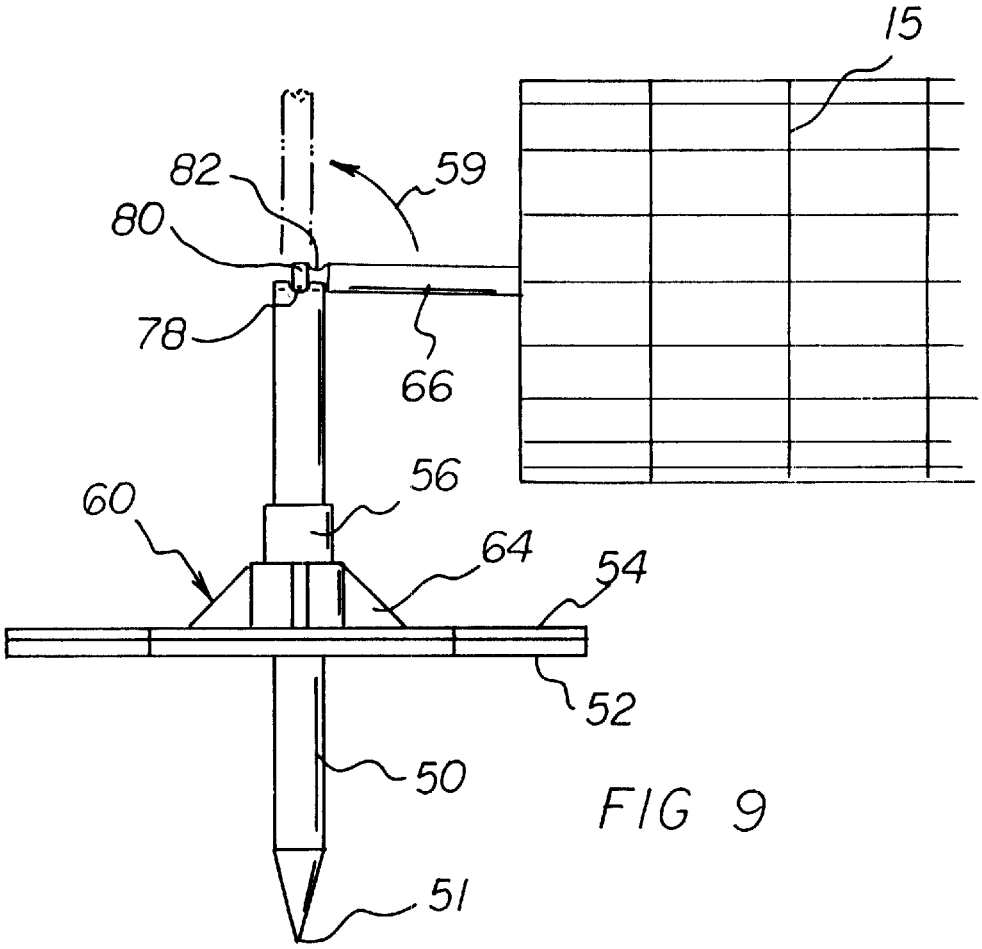
FIG. 9 is a side view of the second embodiment of the invention being loaded with a roll of wire fence.
Figure 10:
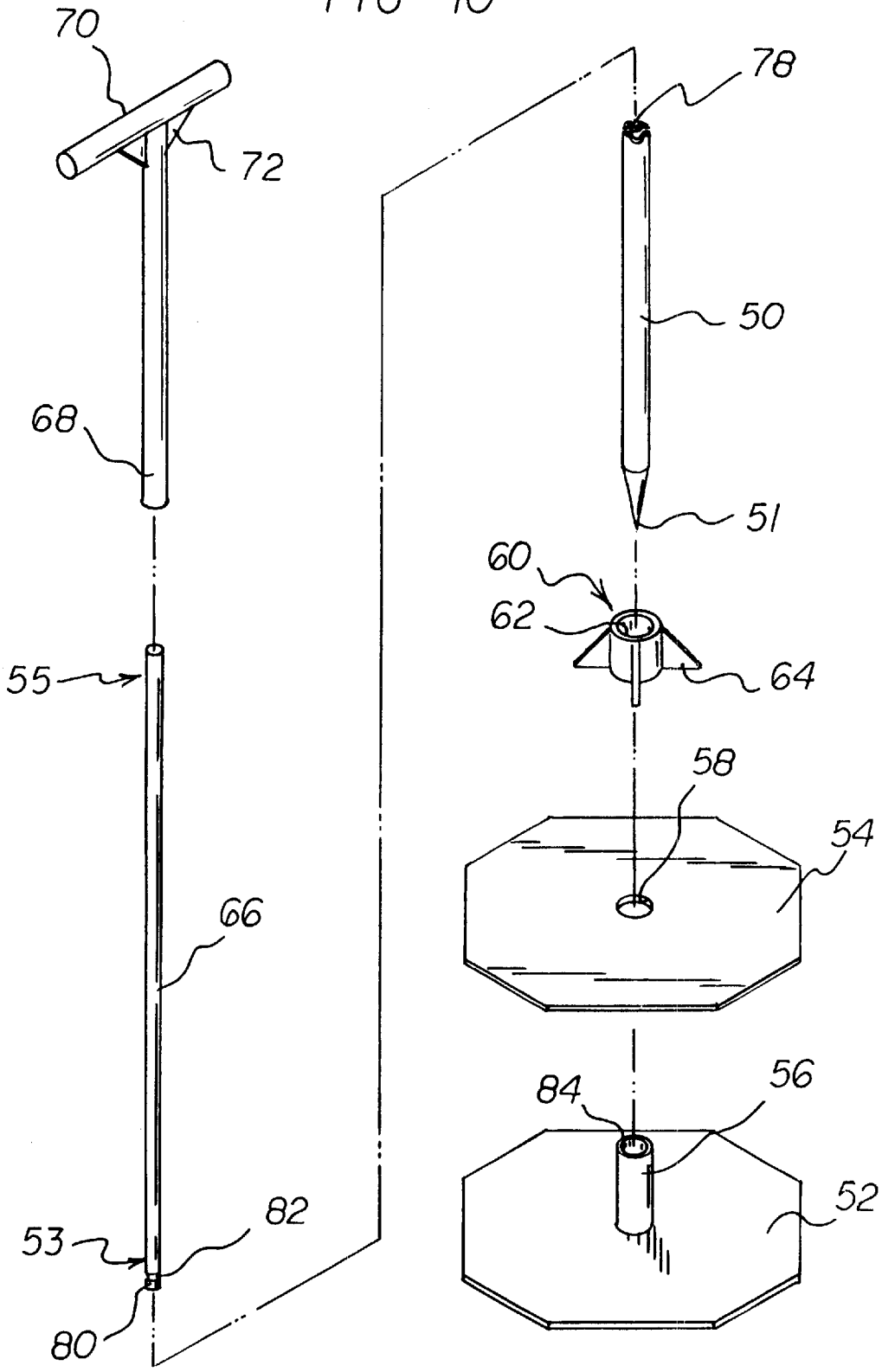
FIG. 10 is an exploded perspective view of the second embodiment of the invention.

After the ground penetration member 50 has been driven into the ground sufficiently, the roll of wire fence 15 can be loaded onto the apparatus. To do so, as illustrated in FIG. 9, the shaft jacket portion 68 is placed around the spindle shaft unit 66, and the combination of the spindle shaft unit 66 and the shaft jacket portion 68 is threaded through the core of the roll of wire fence 15 as the core is oriented in a horizontal direction. The longitudinal positioning of the shaft jacket portion 68 with respect to the spindle shaft unit 66 can be adjusted to adjust leverage and to adjust to accommodate the height of the wire fence 15. Then, the shaft end groove 82 is placed in a notch 78 at the top of the ground penetration member 50, and the handle portion 70 is lifted upwards so that the shaft end groove 82 pivots upon and rotates around the notch 78, as depicted by curved arrow 59. When the roll of wire fence 15 is oriented vertically, the shaft end groove 82 slips off of the notch 78, and the shaft end hammer head 80 slides down into the shaft reception well 76. Once the roll of wire fence 15 is installed on the apparatus, the wire fence 15 can be payed out as described above relating to the first embodiment of the invention.

If the roll of wire fence 15 has a relatively large diameter core, both the bottom centering wings 64 and the top centering wings 72 will partially enter the core and help to center the roll of wire fence 15 as the wire fence 15 is payed out.

Preferably, the bottom centering unit 60 is independent of the cover plate 54. In this respect, when a roll of wire fence 15 is employed that has a relatively small diameter core, the roll of wire fence 15 can fit snugly on the shaft jacket portion 68 without the need for the bottom centering unit 60. Also, if desired, the bottom centering unit 60 can be placed on top of the base plate portion 52, and the cover plate 54 can be placed on top of the bottom centering unit 60. Alternatively, the bottom centering unit 60 can be unified with the cover plate 54 by welding them together.

The components of the fence spool apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved fence spool apparatus that is low in cost, relatively simple in design and operation, and which may advantageously be used for paying out flexible fence material. With the invention, a fence spool apparatus provides flexible fence material from a spool which includes structures for centering the spool on a spindle. With the invention, a fence spool apparatus provides a ground-penetrating member that is located coaxial with the longitudinal axis of the spool. With the invention, a fence spool apparatus is provided which includes an adaptor which is designed to receive hammer blows for driving the ground-penetrating member into the ground.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A fence spool apparatus, comprising:

ground penetration means for penetrating a portion of ground, ground contacting plate means from which a portion of said ground penetration means extend downward therefrom, vertical stabilizer means positioned on top of said ground contacting plate means, ground penetrator driver means for driving a portion of said ground penetration means into the ground, spindle shaft and spool reception means stabilized by said vertical stabilizer means, and top of shaft control means supported by said spindle shaft and spool reception means.

2. The apparatus of claim 1 wherein:

said ground penetration means include base fixing portion, said ground contacting plate means include base plate portion, and said base fixing portion and said base plate portion are unified as a base unit.

3. The apparatus of claim 1 wherein:

said vertical stabilizer means include bottom spindle unit which includes spindle plate portion and bottom shaft-reception sleeve depending upward from said spindle plate portion.

4. The apparatus of claim 1 wherein said ground penetrator driver means include:

hammer-impaction member, and spindle-reception well, in said base plate portion, which receives a portion of said hammer-impaction member.

5. The apparatus of claim 1 wherein said spindle shaft and spool reception means include a spindle shaft unit.

6. The apparatus of claim 1 wherein said top of shaft control means include a fence spool centering assembly supported by said spindle shaft unit.

7. The apparatus of claim 1 wherein:

said ground penetration means include a ground penetration member which includes a ground penetration point at a distal end and a shaft reception well at a proximal end, said ground contacting plate means include a base plate portion, said vertical stabilizer means include a tubular ground-penetration-member reception sleeve attached to a top side of said base plate portion, said ground penetrator driver means include a spindle shaft unit received in said shaft reception well, said spindle shaft and spool reception means include spindle shaft unit which is received in said shaft reception well, and said top of shaft control means include a shaft jacket portion for placement over a top portion of said spindle shaft unit and include a handle portion attached to a top portion of said shaft jacket portion.

8. A fence spool apparatus, comprising:

a base unit which includes a base plate portion, a base fixing portion projecting out from a bottom side of said base plate portion, and a spindle-reception well extending into a top side of said base plate portion, a bottom spindle unit which includes a spindle plate portion, a spindle member projecting out from a bottom side of said spindle plate portion, and a bottom shaft-reception sleeve extending up from a top side of said spindle plate portion, a spindle shaft unit received in said bottom shaft-reception sleeve, a bottom fence spool centering assembly extending between said spindle plate portion and said bottom shaft-reception sleeve, and a top fence spool centering assembly attached to a top portion of said spindle shaft unit.

9. The apparatus of claim 8 wherein said base fixing portion is in a form of a pointed spike.

10. The apparatus of claim 8, further including:

a hammer-impaction member received in said spindle-reception well when said spindle member is not received in said spindle-reception well.

11. The apparatus of claim 8 wherein said base fixing portion and said spindle-reception well are located along a longitudinal axis.

12. The apparatus of claim 8 wherein said bottom fence spool centering assembly includes a plurality of bottom centering rod members extending between said spindle plate portion and said bottom shaft-reception sleeve.

13. The apparatus of claim 8 wherein said top fence spool centering assembly includes:

a top shaft-reception sleeve attached to a top portion of said spindle shaft unit, and a plurality of top centering rods connected to a top portion of said top shaft-reception sleeve and a bottom portion of said top shaft-reception sleeve and extending radially outward from said top shaft-reception sleeve.

14. The apparatus of claim 8 wherein said spindle shaft unit includes:

a first spindle shaft member received in said bottom shaft-reception sleeve, and a second spindle shaft member connected to said first spindle shaft member.

15. A fence spool apparatus, comprising:

a base plate portion, a tubular ground-penetration-member reception sleeve connected to said base plate portion and extending upward therefrom, a ground penetration member received in said tubular ground-penetration-member reception sleeve, for penetrating the ground therethrough, wherein said ground penetration member includes a ground penetration point at a distal end and a shaft reception well at a proximal end, a spindle shaft unit which includes a distal shaft end and a proximal shaft end, wherein said distal shaft end is received in said shaft reception well, a shaft jacket portion placed around said proximal shaft end, and a handle portion connected to a top portion of said shaft jacket portion.

16. The apparatus of claim 15 wherein said handle portion is perpendicular to said shaft jacket portion.

17. The apparatus of claim 15, further including:

top centering wings connected between said handle portion and said shaft jacket portion.

18. The apparatus of claim 15, further including:

a cover plate optionally placed on top of said base plate portion, wherein said cover plate includes a ground-penetration-member reception channel.

19. The apparatus of claim 18, further including:

a bottom centering unit placed on top of said cover plate.

20. The apparatus of claim 18 wherein said bottom centering unit includes a ground-penetration-member-reception channel and bottom centering wings attached to walls of said ground-penetration-member-reception channel.

21. The apparatus of claim 15 wherein said ground penetration member includes notches located at a top rim of walls forming said shaft reception well.

22. The apparatus of claim 15 wherein said distal shaft end includes a shaft end hammer head and a shaft end groove located proximal to said shaft end hammer head.

* * * * *